US007400595B2

(12) United States Patent
Callaway et al.

(10) Patent No.: US 7,400,595 B2
(45) Date of Patent: Jul. 15, 2008

(54) METHOD AND APPARATUS FOR BATTERY LIFE EXTENSION FOR NODES WITHIN BEACONING NETWORKS

(75) Inventors: Edgar H. Callaway, Boca Raton, FL (US); Monique J. Bourgeois, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 578 days.

(21) Appl. No.: 11/017,274

(22) Filed: Dec. 20, 2004

(65) Prior Publication Data

US 2005/0099985 A1 May 12, 2005

Related U.S. Application Data

(62) Division of application No. 10/463,138, filed on Jun. 17, 2003, now Pat. No. 6,879,567.

(51) Int. Cl.
*G08C 17/00* (2006.01)

(52) U.S. Cl. ..... 370/311; 370/338; 455/343.3; 455/574

(58) Field of Classification Search ..... None
See application file for complete search history.

(56) References Cited

U.S. PATENT DOCUMENTS 5,881,055 A 3/1999 Kondo
6,138,034 A * 10/2000 Willey ..... 455/522
6,192,230 B1 2/2001 van Bokhorst et al.
6,505,058 B1 * 1/2003 Willey ..... 455/574
6,671,525 B2 * 12/2003 Allen et al. ..... 455/574
6,879,567 B2 * 4/2005 Callaway et al. ..... 370/311
6,993,325 B1 * 1/2006 Waesterlid ..... 455/414.1
7,193,986 B2 * 3/2007 Scanlon et al. ..... 370/338
7,213,039 B2 * 5/2007 Ramanujam et al. ..... 707/203
2002/0037700 A1 * 3/2002 Dooley et al. ..... 455/41
2003/0031140 A1 2/2003 Oprescu-Surcobe et al.
2003/0081603 A1 * 5/2003 Rune ..... 370/390
2003/0190937 A1 * 10/2003 Karmi et al. ..... 455/574

* cited by examiner

*Primary Examiner*—Wing F. Chan
*Assistant Examiner*—Michael J Moore, Jr.

(57) ABSTRACT

An "identical beacons" field (401) is inserted near the beginning of a transmitted beacon (403) that contains either an integer equal to the number of consecutive identical beacons sent (i.e., identical to the one presently being transmitted) or a repetition bit indicating whether or not the beacon contains changed information when compared to a prior-sent beacon. After sleeping awhile, a node (302-304) wakes up, receives a first portion of the beacon containing the identical beacons field, and analyzes the identical beacons field. Based on the analysis, the node makes a decision on whether to remain "awake" for reception of the remaining beacon or to return to sleep.

8 Claims, 4 Drawing Sheets

—PRIOR ART—

—PRIOR ART—

300

METHOD AND APPARATUS FOR BATTERY LIFE EXTENSION FOR NODES WITHIN BEACONING NETWORKS

FIELD OF THE INVENTION

The present invention relates generally to communication systems and, in particular, to a method and apparatus for battery life extension for nodes within beaconing networks.

BACKGROUND OF THE INVENTION

Many conventional receivers "wake up" periodically to determine if any messages (pages) are scheduled to be transmitted to the receiver or whether the receiver is to communicate with another node within the network. If no messages are scheduled, or if the receiver need not communicate with another network node, the receiver will power down in order to extend the battery life of the receiver. In order to determine whether any action needs to be taken by the receiver, the receiver "listens" to a beacon to determine if the receiver's address is contained within the beacon's transmission. When the address of the receiver is not located within the beacon's transmission, the receiver can be certain that no action needs to be taken by the receiver, and may immediately go to sleep. After a predetermined time period, the receiver will awake again, "listen" to the beacon, and decide whether to stay awake for reception of a message, or to again go to sleep.

In addition to address information, the beacon may contain other information used by network nodes. For example, the beacon may comprise operating parameters such as control information for the network, including status information, types and methods of security employed (message encryption and integrity codes), beacon intervals, etc.

For illustration purposes, one such beacon network developed with such power-saving capabilities is the next generation Code-Division Multiple-Access (CDMA) cellular communication system, more commonly referred to as cdma2000, or Wideband CDMA. As illustrated in FIG. 1, cdma2000 utilizes a plurality of 20 millisecond (ms) synchronous frames 102 (shown as $F_0, F_1, F_2, \ldots, F_K$). Frames 102 are transmitted during a periodically occurring time span corresponding to a transmission cycle that has a predetermined duration (e.g., $1.28*2^N$ seconds, where N is zero or a positive integer). A network node within a cdma2000 system is assigned a group of four frames (referred to as a slot) in which all messages for the particular network node are to be transmitted. A network node operating as such is said to be operating in a "slotted mode." Slotted mode operation allows a cdma2000 network node to power up for a single assigned paging slot every $1.28*2^N$ seconds to determine if any messages are to be transmitted to the receiver.

In order to conserve power, all addresses for network nodes that are to receive messages during a particular slot are broadcast prior to broadcasting the message. If a network node's address is not broadcast within this beacon, the network node can power down for the remainder of the slot. FIG. 2 shows slot 200 having four frames. As shown, a first portion 201 of slot 200 contains address information for all network nodes that have page data within slot 200. A particular network node assigned to slot 200 will awake during the transmission time for slot 200. The network node will receive the first frame, and if the network node's address is not contained within the first portion 201 of slot 200, the network node will power down prior to receiving the rest of slot 200.

Although prior art schemes greatly extend battery life, it is recognized that battery life can be further extended by reducing the amount of time that the receiver spends awake. With battery life being one of the driving factors when choosing consumer products, any increase in batter life is extremely advantageous to equipment manufacturers. Therefore, a need exists for a method and apparatus for further extending battery life for receivers operating within a beaconing network.

DETAILED DESCRIPTION OF THE DRAWINGS

Figure 1:
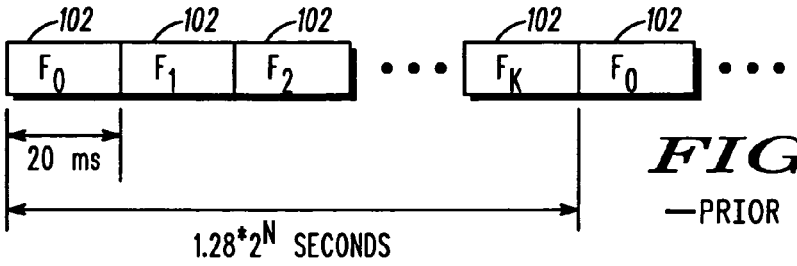
FIG. 1 is an illustration of a prior-art transmission scheme for cdma2000.
Figure 2:
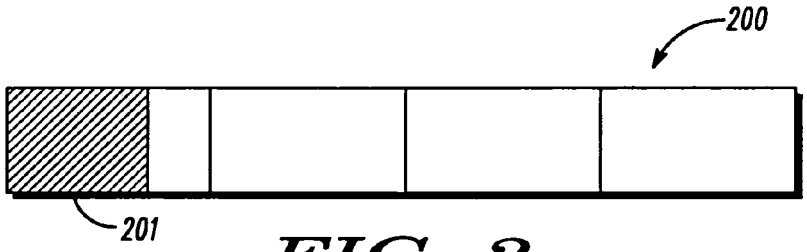
FIG. 2 is an illustration of a prior-art transmission scheme.

To address the above-mentioned need, a method and apparatus for battery-life extension for nodes within a communication system is provided herein. In particular, an "identical beacons" field is inserted near the beginning of a transmitted beacon that contains either an integer equal to the number of consecutive identical beacons sent (i.e., identical to the one presently being transmitted) or a repetition bit indicating whether or not the beacon contains changed information when compared to a prior-sent beacon. After sleeping awhile, a node wakes up, receives a first portion of the beacon containing the identical beacons field, and analyzes the identical beacons field. Based on the analysis, the node makes a decision on whether to remain "awake" for reception of the remaining beacon or to return to sleep.

The present invention encompasses a method for transmitting a beacon within a beacon network. The method comprises the steps of determining if a beacon contains changed content, and based on the determination, inserting a repetition bit into the beacon. The repetition bit indicates whether the beacon contains changed content. The beacon is then transmitted to nodes within the network.

The present invention additionally encompasses a method for transmitting a beacon within a beacon network. The method comprises the steps of determining if a beacon contains changed content, determining an identical beacon counter value indicating a number of identical beacons transmitted, and inserting the identical beacon counter value into the beacon. Finally, the beacon is transmitted to nodes within the network.

The present invention additionally encompasses a method for battery life extension for nodes within a beacon network. The method comprises the steps of receiving a beacon having a repetition bit that indicates whether the beacon contains changed content. Based on whether or not the beacon contains changed content, the node is either placed in a power conservation mode or allowed to receive a rest of the beacon message.

The present invention additionally encompasses a method for battery life extension for nodes within a beacon network. The method comprises the steps of receiving at least a portion of a beacon having an identical beacon field comprising a number of identical beacons transmitted and determining a number of beacons missed since a last received beacon. Based on the identical beacon count and the number of beacons missed since the last received beacon, the node is either placed in a power conservation mode or remains awake to receive a further portion of the beacon message.

The present invention additionally encompasses a beacon comprising a first portion, and a second portion. The first portion comprises an indication as to whether second portion contains changed information, and/or an indication of how many repetitions of second portion has occurred without any change.

The present invention additionally encompasses an apparatus comprising logic circuitry determining if a beacon contains changed content, beacon format circuitry inserting a repetition bit into the beacon, and transmission circuitry for transmitting the beacon.

The present invention additionally encompasses an apparatus comprising logic circuitry that determines if a beacon contains changed content and increments an identical beacon counter value if the beacon is to contain unchanged content. If the beacon is to contain changed content the an identical beacon counter value is reset to a default value, e.g., zero. The apparatus additionally comprises beacon format circuitry that inserts the identical beacon counter value into the beacon, wherein the identical beacon counter value indicates a number of identical beacons transmitted, and transmission circuitry for transmitting the beacon.

The present invention additionally encompasses an apparatus comprising receive circuitry for receiving at least a portion of a beacon having a repetition bit that indicates whether the beacon contains changed content. The apparatus additionally contains logic circuitry for placing a node in a power conservation mode based on whether or not the beacon contains changed content.

Finally, the present invention encompasses an apparatus comprising receive circuitry for receiving at least a portion of a beacon having an identical beacon field comprising a number of identical beacons transmitted. The apparatus additionally comprises logic circuitry for determining a number of beacons missed since a last received beacon; based on a value in the identical beacon field and the number of beacons missed since the last received beacon, the logic circuitry places a node in a power conservation mode or remains awake to receive a further portion of the beacon message.

Figure 3:
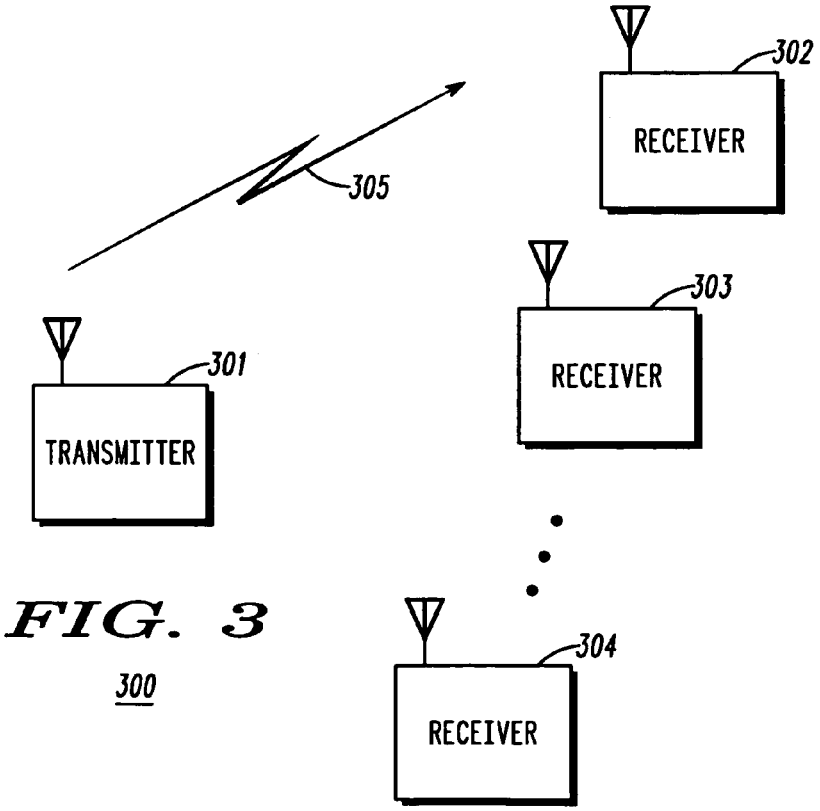
FIG. 3 is a block diagram of a communication system in accordance with the preferred embodiment of the present invention.

Turning now to the drawings, where like numerals designate like components, FIG. 3 is a block diagram of communication system 300 in accordance with the preferred embodiment of the present invention. As shown, communication system 300 comprises transmitter 301, and a plurality of receivers (or nodes) 302-304. In a preferred embodiment, receivers 302-304 are selective call receivers, each assigned one or more unique identifying addresses. Although only three receivers are shown, one of ordinary skill in the art will recognize that typical communication systems comprise many receivers in simultaneous communication with transmitter 301. Further, although only one transmitter is shown, one of ordinary skill in the art will recognize that typical communication systems comprise many transmitters 301 in communication with receivers 302-304. Additionally, in the following discussion communication 300 may utilize any system protocol that employs a beacon-type network, where receivers periodically awake to receive messages. For example, it is easily envisioned that communication system 300 may utilize an IEEE 802.11b Wi-Fi™ (WLAN) protocol, a Bluetooth™ protocol, an IEEE 802.15.3 WiMedia™ (WPAN™) protocol, or an EEEE 802.15.4 (ZigBee™) system protocol, or any next-generation cellular protocol such as cdma2000, or Wideband CDMA. Additionally, in alternate embodiments of the present invention, communication system 300 may comprise a peer-to-peer network in which all devices transmit and receive on an equal basis.

As discussed above, receivers (network nodes) 302-304 "wake up" periodically and listen to beacon 305 (regularly transmitted by transmitter 301) to determine if any action needs to be taken by a node. Such actions include but are not limited to receiving scheduled transmissions, and instructions to communicate with another network node. Besides message scheduling and availability information, beacon 305 may contain other operating parameters/control information needed by receivers 302-304. For example, a beacon period length, status information, types and methods of security employed by the network (e.g., message encryption and integrity codes), beacon intervals, communication channels to employ, network dissociation instructions, a broadcast address indicating that all receivers are to receive messages, and a multicast addresses indicating that one or more groups of one or more receivers are to receive messages, . . . , etc. may be transmitted via beacon 305 and utilized by a network node. Nodes 302-304 also "wake up" periodically and listen to beacon 305 to receive updates to these operating parameters.

If beacon 305 contains no information for a particular receiver, the receiver will power down in order to extend the battery life. In order to determine whether or not information contained within beacon 305 is useful to a particular receiver, the receiver will monitor beacon 305 to determine if either a particular receiver's address is contained within the beacon's transmission, or monitor a specific field within beacon 305 to determine if certain operating parameters have changed. When the address of a particular receiver 302-304 is not located within the beacon's transmission, or when it is determined that operating parameters have not changed, the particular receiver 302-304 can immediately go to sleep. After a predetermined time period, receivers 302-304 will awake again, "listen" to beacon 305, and decide whether to stay awake for reception of a message, or to again go to sleep.

In the preferred embodiment of the present invention it is recognized that in many communication networks information within a beacon changes very slowly. For example, beacon periods may be on the order of 15-20 ms, yet a typical network may run all night with little, if any, messaging traffic. With this in mind, in the preferred embodiment of the present invention several techniques are employed to further extend battery life. In a first embodiment of the present invention, a "repetition" bit is placed in an "identical beacons" field early in the beacon frame, having at least two possible values—a value indicating that the information in the present beacon transmission is identical to that of a preceding beacon transmission, and a value indicating that the information in the two beacon transmissions is not identical. The value of the repetition bit itself, of course, is not included in this comparison. When there is no preceding beacon transmission (for example, when transmitter 301 has just been activated), the repetition bit is given a value indicating the information is not identical.

When the repetition bit indicates a repeated beacon transmission, any receiver within communication system 300 can use this information to return to sleep immediately (i.e., enter a power conservation mode) after receiving the bit without having to receive the remainder of the beacon. When the repetition bit indicates the transmission of changed (unrepeated) information in the beacon, receivers within communication system 300 continue receiving the entire beacon. Thus, in the first embodiment of the present invention, the repetition bit within the beacon acts as a flag that indicates the presence of changed information (e.g., addresses, encryption type, beacon period, . . . , etc.) within the beacon.

In a second embodiment of the present invention, an "identical beacons" field is transmitted near the beginning of the beacon that contains an integer value equal to a number of consecutive beacons already transmitted that are identical to the present beacon. Receiving nodes may then sleep through one or more transmitted beacons, keeping a "skipped beacons" counter indicating the number of beacons they have skipped. After sleeping, a node (e.g., a receiver) wakes up, receives the identical beacons field within the beacon, and compares a value in the transmitted identical beacons field with a value in its skipped beacons counter. If a value in the skipped beacons counter is less than a value in the identical beacons field, the receiving node knows it has not missed a beacon update, and may immediately return to sleep for the remaining portion of the beacon transmission, since the remaining portion of the beacon transmission contains only information the node has received at an earlier time. The receiving node may continue to sleep through one or more transmitted beacons, repeating the procedure. The skipped beacons counter is incremented once for each beacon through which the receiving device has (at least partially) slept; i.e., for each beacon transmitted since a complete beacon was received. However, if a value in the skipped beacons counter is greater than or equal to a value in the identical beacons field, the receiving node knows an update has occurred since the beacon was last received, and it must stay in receive mode through the entire beacon to receive the update. It then resets its "skipped beacons" value to zero. After receiving the updated beacon, the receiving node takes any action required of it; if none is required it may return to sleep, repeating the procedure.

It should be noted that in the second embodiment, the number of beacons a node chooses to skip may be dynamic, based on the frequency with which it receives updated beacons. This may extend the life of networks with varying load, such as diurnal variations that occur in office networks.

Because both embodiments described above allow a receiver to go to sleep for longer periods of time, both help to conserve battery life. The goal of both the first and the second embodiments are to save power and thus preserve the life of the receiver's power source. Thus, when a receiver determines that a beacon is similar to a previously received beacon, the receiver is placed in a power conservation mode to conserve power which would otherwise be required to continue monitoring the beacon. The receiver can take many steps to conserve power, and depending upon the communication system protocol, the steps taken include, but are not limited to, one or more of the following:

1. Turning off/removing power from at least a portion of a radio receiver;

2. Turning off/removing power from at least a portion of a frequency synthesizer;

3. Turning off/removing power from hardware performing despreading;

4. Turning off/removing power from hardware performing deinterleaving;

5. Turning off/removing power from hardware performing decoding;

6. Not turning on/applying power to hardware performing despreading;

7. Not turning on/applying power to hardware performing deinterleaving;

8. Not turning on/applying power to hardware performing decoding;

9. Not executing software instructions used to perform deinterleaving; or

10. Not executing software instructions used to perform decoding; and

11. Reducing current or voltage for various components within the receiver.

Figure 4:
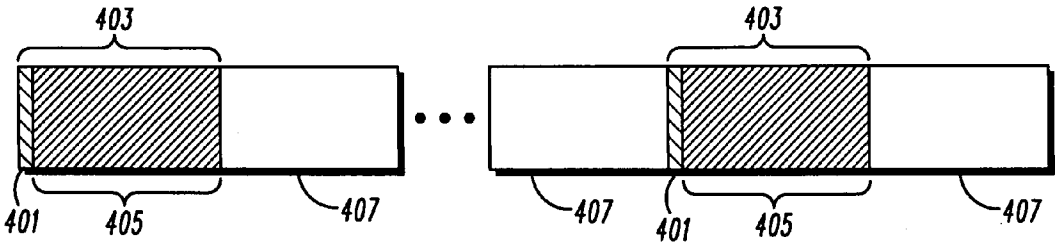
FIG. 4 is an illustration of a beacon in accordance with the preferred embodiment of the present invention.

FIG. 4 is an illustration of a beacon message within a frame structure in accordance with the preferred embodiment of the present invention. FIG. 4 specifically shows beacon message 403 having a first portion 401 and a second portion 405. As discussed above, first portion 401 comprises an indication as to whether second portion 405 contains changed information, and/or an indication of how many unchanged repetitions of second portion 405 have occurred. As one of ordinary skill in the art will recognize, second portion 405 of beacon message 403 may comprise address information for those receivers that are to receive messages within subsequent frames 407, or may comprise operating parameters such as control information for the network, The address information/operating parameters within second portion 405 of beacon message 403 may be arranged as is known in the art. For example, address information within second portion 405 may be of a format that utilizes partial address comparison known in the art. Such a technique for ordering address information within second portion 405 is described in detail in U.S. Pat. No. 5,666,657 METHOD IN A SELECTIVE CALL RECEIVER FOR APPLYING CONDITIONAL PARTIAL ADDRESS CORRELATION TO A MESSAGE, by Kampe et al. Additionally, other techniques may be utilized to order address information within second portion 405. These techniques include, but are not limited to, ordering by numerical order and ordering by geographical zones.

Figure 5:
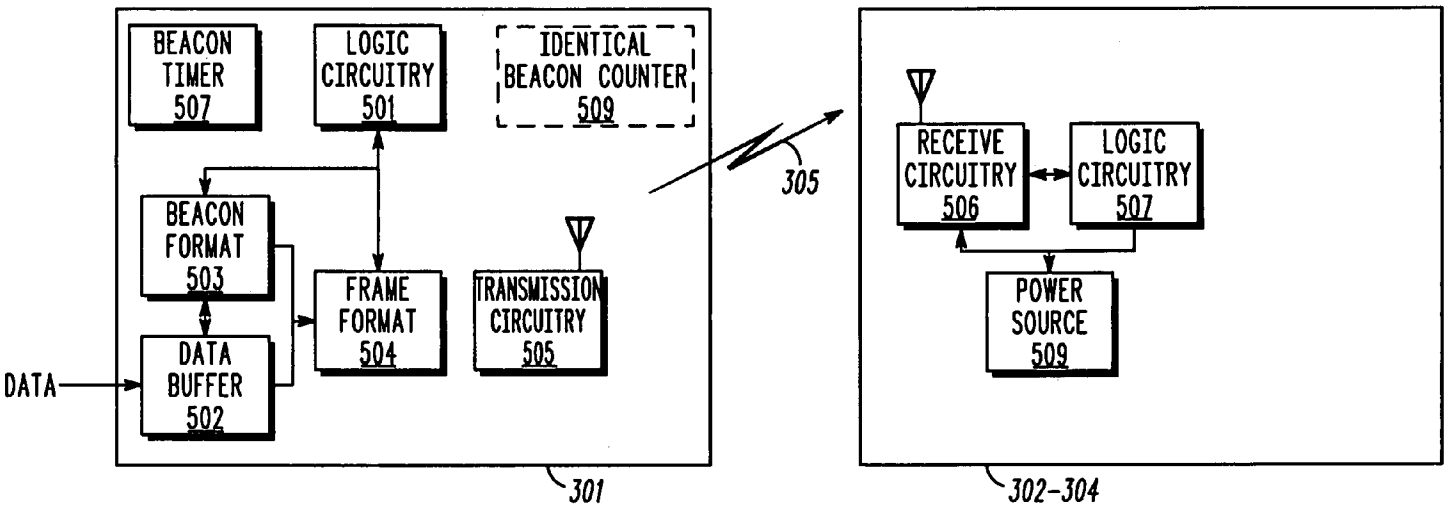
FIG. 5 is a more-detailed block diagram of a transmitter and receiver in accordance with the preferred embodiment of the present invention.
Figure 6:
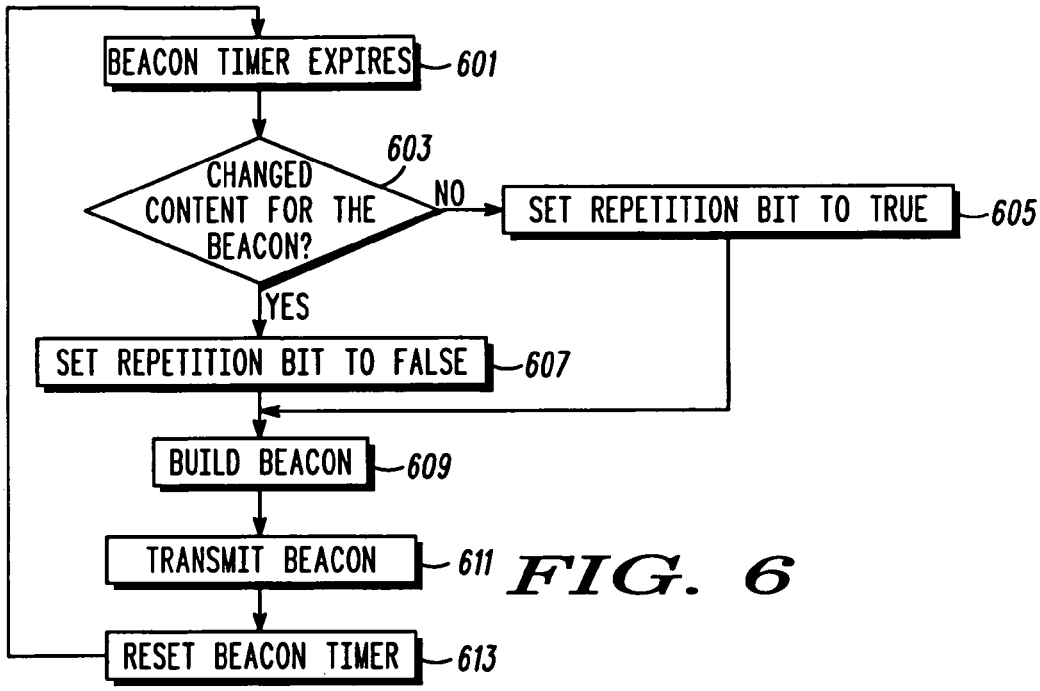
FIG. 6 is a flow chart showing operation of the transmitter in accordance with the first embodiment of the present invention.

FIG. 5 is a more-detailed block diagram of transmitter 301 and a receiver (e.g., receiver 302). As shown, transmitter 301 comprises logic circuitry 501 controlling beacon format circuitry 503, data buffer 502, frame format circuitry 504, and transmission circuitry 505. In the second embodiment of the present invention transmitter 301 additionally comprises identical beacon counter 509. Logic circuitry 501 serves as means for determining if a beacon contains changed content, and preferably comprises a microprocessor such as a Motorola HC08 processor. In a similar manner, logic circuitry 507 serves as means for analyzing a received beacon message to determine the value of a repetition bit or the value of an identical beacons counter and compares it to a number of skipped beacons. Logic circuitry 507 additionally comprises a microprocessor such as a Motorola HC08 processor. Operation of transmitter 301 in accordance with the first embodiment of the present invention occurs as shown in FIG. 6.

The logic flow begins at step 601 where logic circuitry 501 determines that beacon timer 507 has expired. At step 603 it is determined if the beacon is to contain a change in content (other than a change in a repetition bit). It should be noted that step 603 specifically determines if the beacon is to contain a change in content, and does not simply determine if the beacon has new information. This is because if a receiving node picks up a message, its address is deleted from the beacon's address list; forcing a changed beacon even though no new data is to be transmitted by the transmitting node.

As discussed above, beacon content may be changed for several reasons. Firstly, the beacon may contain changed address information for nodes having messages to be transmitted to them or for nodes that are to communicate with another network node. Additionally, transmitting node 301 may itself generate a change of information in the beacons (e.g., a change in beacon period length, types of encryption, etc.). Thus, at step 603 in determining whether or not beacon content is to be changed, logic circuitry analyzes data buffer 502 to determine if a list of addresses of nodes with awaiting messages has changed, or determines if control information has changed.

If at step 603 it is determined that the beacon contains changed content, the logic flow continues to step 607 where logic circuitry 501 sets a value of a repetition bit to "false", otherwise the logic flow continues to step 605 where a value of a repetition bit is set to "true". At step 609 beacon format circuitry 503 builds the beacon. In particular, beacon format circuitry 503 analyzes buffer 502 to determine address information for those receivers that have data to be transmitted to them. Additionally, logic circuitry 501 transmits any change in operating parameters to beacon format circuitry 503 along with the repetition bit value. Utilizing this information, beacon format circuitry builds the beacon by inserting address information and/or control information into the beacon along with the repetition bit. As discussed above, beacon format circuitry 503 inserts the repetition bit into the beacon, preferably near the beginning of the beacon. At step 611 the beacon is output to frame format circuitry 504 where it is appropriately formatted and transmitted by transmitter 505. At step 613 beacon timer 507 is reset and the logic flow returns to step 601.

Figure 7:
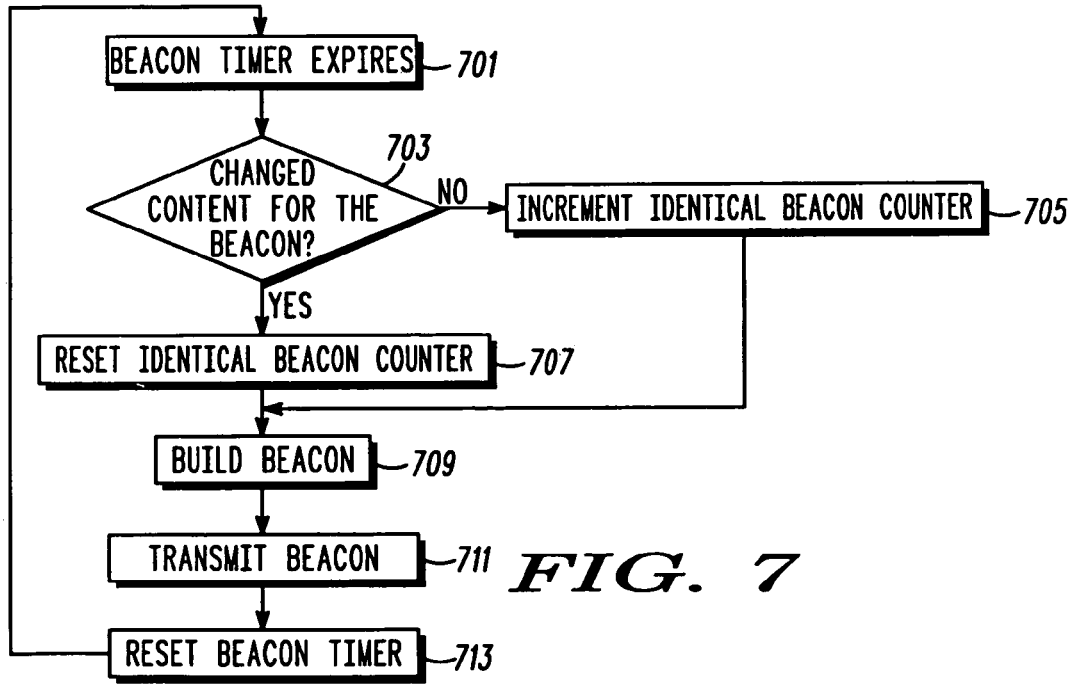
FIG. 7 is a flow chart showing operation of the transmitter in accordance with a second embodiment of the present invention.

Operation of transmitter 301 in accordance with the second embodiment of the present invention occurs as shown in FIG. 7. The logic flow begins at step 701 where logic circuitry 501 determines that beacon timer 507 has expired. At step 703 logic circuitry 501 determines if the beacon is to contain changed content (other than an identical beacon counter value). If at step 703 it is determined that the beacon contains no changed content, the logic flow continues to step 705 where identical beacon counter 509 is incremented by logic circuitry 501. However, if at step 703 it is determined that the beacon contains changed content, the logic flow continues to step 707 where identical beacon counter 509 is reset to zero. At step 709 beacon format circuitry 503 builds the beacon. In particular, beacon format circuitry 503 analyzes buffer 502 to determine address information for those receivers that have data to be transmitted to them. Additionally, logic circuitry 501 transmits any change in operating parameters to beacon format circuitry 503 along with the value of identical beacon counter 509. Utilizing this information, beacon format circuitry builds the beacon by inserting address information and/or control information into the beacon. Additionally, beacon format circuitry 503 inserts the value of identical beacon counter 509 into the beacon, preferably near the beginning portion of the beacon. At step 711 the beacon is output to frame format circuitry 504 where it is appropriately formatted and transmitted by transmitter 505. At step 713 beacon timer 507 is reset and the logic flow returns to step 701.

As discussed above, because both embodiments described above allow a receiver to go to sleep for longer periods of time, both help to conserve battery life. The goal of both the first and the second embodiments are to save power and thus preserve the life of the receiver's power source. Thus, when a receiver determines that a beacon is similar to a previously received beacon, the receiver conserves power which would otherwise be required to continue monitoring the beacon. As shown, receiver 302 comprises receive circuitry 506, logic circuitry 507, and power source 509. As one of ordinary skill in the art will recognize, power source 509 typically comprises a battery power source that serves to power receiver 302.

Figure 8:
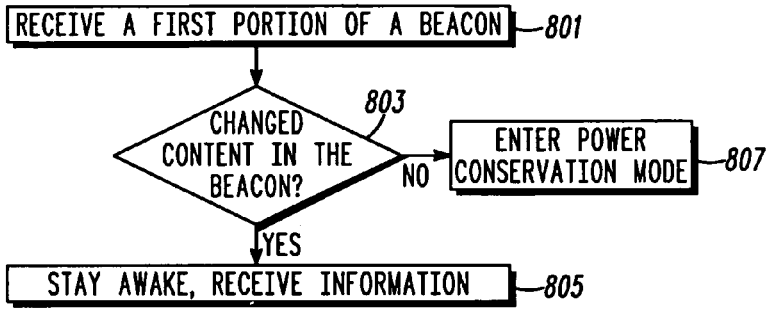
FIG. 8 is a flow chart showing operation of the receiver in accordance with the first embodiment of the present invention.

The operation of receiver 302 in accordance with the first embodiment of the present invention occurs as illustrated in FIG. 8. The logic flow begins at step 801 where receive circuitry 506 receives a first portion of a beacon transmission. As discussed above, in the first embodiment of the present invention, a first portion of a beacon transmission comprises a repetition bit that indicates whether or not information within the beacon has been changed from a beacon preceding the present beacon. At step 803, logic circuitry 507 serves as means for analyzing the beacon to determine if the information has been changed since the last beacon transmission. If, at step 803, it is determined that information has been changed, then the logic flow continues to step 805 where a further portion of the beacon is received to determine the added information. However, if, at step 803 it is determined that the information has not been changed, then the logic flow continues to step 807 where receive circuitry is placed in a power-conservation mode, conserving power source 509.

Figure 9:
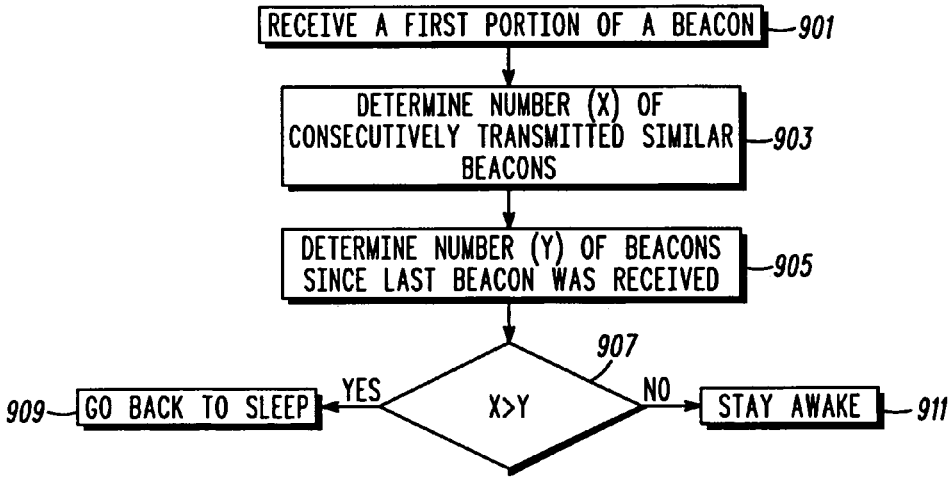
FIG. 9 is a flow chart showing operation of the receiver in accordance with the second embodiment of the present invention.

FIG. 9 is a flow chart showing operation of the receiver in accordance with the second embodiment of the present invention. The logic flow begins at step 901 where a first portion of a beacon is received by receive circuitry 506. At step 903 the a first portion of a beacon is analyzed by logic circuitry 507 to determine a number (X) of consecutively-transmitted similar beacons. This can be done by evaluating the "identical beacons" field of the beacon. At step 905, logic circuitry 507 determines how many beacons (Y) were skipped, or missed, since the last beacon was received. Next, at step 907, logic circuitry determines if X>Y, and if so the logic flow continues to step 909 where the receiver enters a power conservation mode (e.g., goes back to sleep), otherwise the logic flow continues to step 911 where the receiver remains active to receive a further portion of the beacon.

The descriptions of the invention, the specific details, and the drawings mentioned above, are not meant to limit the scope of the present invention. For example, although the first and second embodiments were given as separate embodiments, one of ordinary skill in the art will recognize that a combination of both the first and the second embodiment may take place. It is the intent of the inventor that various modifications can be made to the present invention without varying from the spirit and scope of the invention, and it is intended that all such modifications come within the scope of the following claims and their equivalents.

The invention claimed is:

1. A method for transmitting a beacon within a beacon network, the method comprising the steps of:

determining if a beacon contains changed content;

based on the determination, inserting a repetition bit into the beacon, wherein the repetition bit indicates whether the beacon contains changed content; and transmitting the beacon to nodes within the network.

2. The method of claim 1 further comprising the step of:

inserting address information within the beacon, wherein the address information comprises addresses for nodes within the network that are to receive a scheduled transmission or to communicate with another network node.

3. The method of claim 1 further comprising the step of:

inserting control information within the beacon.

4. The method of claim 1 wherein the step of inserting the repetition bit into the beacon comprises the step of inserting the repetition bit into a beginning portion of the beacon.

5. A method for battery life extension for nodes within a beacon network, the method comprising the steps of:

receiving a beacon, wherein the beacon comprises a repetition bit that indicates whether the beacon contains changed content; and based on whether or not the beacon contains changed content, either placing the node in a power conservation mode or staying awake to receive a further portion of the beacon message.

6. The method of claim 5 wherein the step of receiving the beacon comprises the step of receiving a beacon comprising the repetition bit and address information, wherein the address information comprises addresses for remote nodes within the network that are to receive a scheduled transmission or to communicate with another network node.

7. The method of claim 5 wherein the step of receiving the beacon comprises the step of receiving a beacon comprising the repetition bit and control information.

8. An apparatus comprising:

logic circuitry determining if a beacon contains changed content;

beacon format circuitry inserting a repetition bit into the beacon, wherein the repetition bit indicates whether the beacon contains changed content; and transmission circuitry for transmitting the beacon.

* * * * *